252-99 AU 166 EX
7/25/78 OR 4,102,799

United States Patent [19]
Finck

[11] 4,102,799
[45] * Jul. 25, 1978

[54] AUTOMATIC DISHWASHER DETERGENT WITH IMPROVED EFFECTS ON OVERGLAZE

[75] Inventor: Patricia A. Finck, Bayonne, N.J.

[73] Assignee: Colgate-Palmolive Company, New York, N.Y.

[ * ] Notice: The portion of the term of this patent subsequent to Oct. 31, 1989, has been disclaimed.

[21] Appl. No.: 664,337

[22] Filed: Mar. 5, 1976

Related U.S. Application Data

[63] Continuation of Ser. No. 501,720, Aug. 29, 1974, abandoned, which is a continuation of Ser. No. 335,461, Feb. 26, 1973, abandoned, which is a continuation of Ser. No. 133,337, Apr. 12, 1971, abandoned.

[51] Int. Cl.[2] ..... C11D 7/54

[52] U.S. Cl. ..... 252/99; 252/95; 252/103; 252/DIG. 10; 252/DIG. 11

[58] Field of Search ..... 252/99, 95, 89, 103, 252/DIG. 11, DIG. 10; 8/108

[56] References Cited

U.S. PATENT DOCUMENTS

| | | | |
|---|---|---|---|
| 3,494,868 | 2/1970 | Gray | 252/99 |
| 3,692,684 | 9/1972 | Hentschel | 252/99 X |
| 3,701,735 | 10/1972 | Finck | 252/99 |
| 3,761,415 | 9/1973 | Gould | 252/89 |

*Primary Examiner*—Mayer Weinblatt
*Attorney, Agent, or Firm*—Norman Blumenkopf; Herbert S. Sylvester; Murray M. Grill

[57] ABSTRACT

An alkaline dishwasher detergent capable of inhibiting overglaze attack and essentially free of inorganic phosphates, containing at least 35% by weight of a water-soluble citrate compound, and one or more water-soluble, inorganic builder salts such as silicates, carbonates and/or sulfate.

3 Claims, No Drawings

AUTOMATIC DISHWASHER DETERGENT WITH IMPROVED EFFECTS ON OVERGLAZE

This is a continuation of application Ser. No. 501,720 filed Aug. 29, 1974 which in turn is a continuation of Ser. No. 335,461 filed Feb. 26, 1973, which in turn is a continuation Ser. No. 133,337 filed Apr. 21, 1971 all now abandoned.

The present invention relates to a non-phosphate builder-cleaning composition beneficially adapted to cleaning dishware and the like in automatic dishwashers.

The presence of a hard water sequestrant is an essential ingredient in a detergent formulation and constitutes a major component in automatic dishwashing compositions. In currently marked products, this function is provided for by the presence of inorganic phosphates which greatly influence performance properties. However, there has been criticism by some individuals of phosphorus as a possible pollutant in certain waters. Consequently, there has been considerable research towards the development of a non-phosphated formulation, possessing the requisite measure of cleaning activity. Performance deficiencies such as undue spotting, filming, and overglaze tend to result from the removal and/or replacement attack of the inorganic phosphate salts.

In accordance with the present invention, it has now been found that the water-soluble citrates are suitable replacements for the inorganic phosphates, thereby providing a dishwasher detergent formulation possessing superior cleaning efficacy and improved overglaze protective properties.

Thus, a primary object of the present invention is the provision of an efficacious non-phosphated detergent formulation.

Another object of the present invention is the provision of a dishwasher product having improved overglaze protective properties.

Still another object of the present invention is the provision of a commercially more desirable cleaning product.

Other objects and advantages of the present invention will become more apparent hereinafter as the description proceeds.

The attainment of the foregoing and related objects is made possible in accordance with the present invention which provides a water-soluble alkaline detergent for automatic dishwashing essentially free of inorganic phosphates, containing at least about 35% by weight of a water-soluble citrate compound and about 30–65% of at least one water-soluble inorganic builder salt selected from the group of silicates, carbonates and sulfates.

The citrate component of the present invention may be supplied as sodium citrate or as any other water-soluble salt of a cation such as an alkali metal (e.g., potassium, lithium), ammonium, amine, alkylolamine and the like. Citric acid may also be used with any suitable alkali such as sodium hydroxide or carbonate when available as a reactant therewith in the use of the product.

The citrate compounds may be used in the form of hydrates or in anhydrous form. It has been found that the crystalline dihydrate of sodium citrate, which has an apparent density of 1, is preferred due to ease with which it can be blended with the other particulate ingredients to yield a product having good flowability. The anhydrous sodium citrate which has a lower apparent density, a more desirable attribute of this ingredient, is a very fine powder and more difficult to blend with the other ingredients of the detergent composition. Furthermore, the formulation utilizing anhydrous sodium citrate has been found to be dusty with poor flowability. The use of mixtures of the hydrated and anhydrous sodium citrate has somewhat alleviated the density and dusting problems. However, both the hydrated and anhydrous citrate compound are equally efficacious in their detergency properties, their selection being dependent on compatibility with the other ingredients present in the final product.

The citrate compound constitutes an essential ingredient of instant non-phosphated detergent formulations, in amounts of at least 35% by weight of the total composition, usually up to and including 60% by weight of the total composition. The performance in the dishwasher has been evaluated by spotting and film tests in accordance with the method of CSMA, specifically defined in "Soap and Chemical Specialties," Vol. 33, No. 9, Sept. (1957). This method is modified to show spotting and film build up on glass tumblers and plates in the presence of a milk-margarine-egg soil. According to such method, five glass tumblers and five photographic cover plates are spaced on the top rack and six dinner plates plus smaller plates are spaced on the lower rack of a washer. Detergent receptacles of the machine are each filled with 30 grams of detergent to give a 0.3% aqueous solution. Forty grams of the above defined soil is placed at bottom of the machine. With water at 140° F. and 50 ppm or 150 ppm or 200 ppm water hardness, the machine is put through its standard cycle. The contents are cooled to about 75° F before observation in adequate light and are rated according to the following scale:

1. glass spotless and no film
2. spots at random or barely perceptible film
3. ¼ of glass covered with spots or apparent film
4. ½ of glass covered with spots of moderate film
5. glass completely covered with spots or heavy film.

Instant citrate containing detergents favorably compare with the conventional phosphate-containing detergents presently on the market in regard to both spotting and filming.

In addition, instant compositions exhibited superior protection against overglaze attack compared to aforesaid phosphate-containing detergents. For purposes of ascertaining the capacity of the various compositions exemplified to ameliorate overglaze attack on fine china samples, the method of the Chemical Specialties Manufacturers Association (CSMA) is employed, such method being described in detail in "Soap and Chemical Specialties," 33, (9), 60, 1957. Such test is designed as an accelerated dishwasher exposure method; thus, the comparative removal of overglaze decoration provides direct means for affording an evaluation of the corrosiveness of dishwashing detergent solutions. According to such method, samples of standard plates (Greenwood pattern) Onondaga Pottery Co., Syracuse, N.Y. are immersed in deionized or distilled water maintained at a temperature of 211° F. and containing the indicated percent concentration of detergent for periods of 2, 4 and 6, hours. The test samples are thereafter removed, hand-rubbed with cloth and compared with untreated samples of the same standard plate. The treated samples are visually scrutinized to determine the extent of overglaze damage with numerical indicia being assigned to indicate the extent of overglaze damage involved. Thus, the scale of 0, 1, 2, 3 and 4 correspond, in terms of damage, to none, slight, moderate, considerable and complete respectively.

The inorganic water-soluble builder adjuvants used as supplemental materials include at least one of the following: borates such as borax, carbonates such as sodium carbonate, bicarbonate, silicates, e.g., $SiO_2$ to $Na_2O$ ratio of 1:1 to 3.2 to 1, such as sodium metasilicate and hydrous silicates, sulfates and bisulfates such as the sodium salts thereof. Any other watersoluble salt may be employed such as an alkali metal (e.g., potassium, lithium), ammonium, amine, alkylolamine and the like. The builder salts are preferably employed in amounts of about 30–65% by weight and sufficient to yield a pH in water of from 9.5 to 12, preferably 9.5 to 11, in order to obtain optimum detergency performance.

The cleaning composition of this invention has particular utility as an automatic dishwasher product which customarily and preferably contains one or more bleaching agents capable of liberating hypochlorite chlorine and/or hypobromite bromine on contact with aqueous media. Particular examples of bleaching agents include the dry, particulate heterocyclic N-bromo and N-chloro imides such as trichlorocyanuric, tribromocyanuric acid, dibromo- and dichlorocyanuric acid, the salts thereof with water-solubilizing cations such as potassium and sodium, and mixtures thereof. Particular compounds found useful are potassium dichloroisocyanurate and trichloroisocyanuric acids.

Other N-bromo and N-chloro imides may also be used, such as N-brominated and N-chlorinated succinimide, malonimide phthalimide and naphthalimide. Other compounds include the hydantoins, such as 1,3-dibromo and 1,3-dichloro-5,5-dimethylhydantoin; N-monochloro-5, 5-dimethylhydantoin, methylene-bis (N-bromo-5, 5-dimethylhydantoin); 1,3-dibromo and 1,3-dichloro 5-isobutylhydantoin; 1,3-dichloro 5, methyl-5-ethylhydantoin; 1,3-dibromo and 1,3 dichloro,5,5-diisobutyl-hydantoin; 1,3-dibromo and 1,3-dichloro 5-methyl-5-n-amylhydantoin, and the like. Other useful hypohalite-liberating agents comprise tribromomelamine and trichloromelamine. Dry particulate, water soluble anhydrous inorganic salts are likewise suitable for use such as lithium hypochlorite and hypobromite. The hypohalite-liberating agent may, if desired, be provided in the form of a stable, solid complex or hydrate, such as sodium p-toluene-sulfo-bromamine-trihydrate, sodium benzene-sulfo-chloramine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water as necessary) likewise comprise efficacious materials. The present invention contemplates as an additional embodiment the use of bleaching agents capable of liberating hypochlorite as well as hypobromite such as, for example, the N-brominated, N'-chlorinated heterocyclic imides, as for example the N-bromo, N'chlorocyanuric acids and salts thereof, e.g., N-monobromo-N, N-dichlorocyanuric acid, N-monobromo-N-monochlorocyanuric acid, sodium-N-monobromo-N-monochloro-cyanurate, potassium-N-monobromo-N-monochloro-cyanurate; and the N-brominated, N-chlorinated hydantoins, e.g., N-bromo-N-chloro-5, 5-dimethylhydantoin and N-bromo-N-chloro-5-ethyl-5-methyl hydantoin.

The hypohalite-liberating compound is employed in an amount of from 0.5 to 5% by weight of the composition, and preferably in an amount of from about 0.5 to 3% by weight thereof. In any event, the hypohalide material should preferably be employed in amounts sufficient to yield from about 0.5–3% available chlorine, bromine, etc., in order to assure optimum results.

Water soluble organic detergents, i.e., surface active components may be employed, such materials being well known in the prior art, the term detergent comprehending species of the anionic, cationic, amphoteric and zwitterionic, non-ionic types. In formulating an automatic dishwasher product, it is preferred to utilize a low-foaming detergent such as the nonionics.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols of monoesters of hexahydric alcohols and inner ethers thereof such as sorbitan monolaurate, sorbitol mono-oleate and mannitan monopalmitate, and the condensation products of polypropylene glycol with ethylene oxide.

Further suitable detergents are polyoxyalkene esters of organic acids, such as the higher fatty acids, rosin acids, tall oil, or acids from the oxidation of petroleum, and the like. The polyglycol esters will usually contain from about 8 to about 30 moles of ethylene oxide or its equivalent and about 8 to 22 carbon atoms in the acyl group. Suitable products are refined tall oil condensed with 16 to 20 ethylene oxide groups, or similar polyglycol esters of lauric, stearic, oleic and like acids.

Additional suitable non-ionic detergents are the polyalkylene oxide condensates with higher fatty acid amides, such as the higher fatty acid primary amides and higher fatty acid mono- and di-ethanol-amides. Suitable agents are coconut fatty acid amide condensed with about 10 to 30 moles of ethylene oxide. The fatty acyl group will similarly have about 8 to 22 carbon atoms, and usually about 10 to 18 carbon atoms in each product. The corresponding sulphonamides may also be used if desired.

Other suitable polyether non-ionic detergents are the polyalkylene oxide ethers of higher aliphatic alcohols. Suitable alcohols are those having a hydrophobic character, and preferably 8 to 22 carbon atoms. Examples thereof are iso-octyl, nonyl, decyl, dodecyl, tridecyl, tetradecyl, hexadecyl, octadecyl and oleyl alcohols which may be condensed with an appropriate amount of ethylene oxide, such as at least about 6, and preferably about 10–30 moles. A typical product is tridecyl alcohol, produced by the Oxo process, condensed with about 12, 15 or 20 moles of ethylene oxide. The corresponding higher alkyl mercaptans or thioalcohols condensed with ethylene oxide are also suitable for use in compositions of the present invention.

Examples of other suitable wetting agents include low foaming anionic materials such as dodecyl hydrogen phosphate, methyl naphthalene sulfonate, sodium 2-acetamido-hexadecane-1-sulfonate, and mixtures thereof. Mixtures of the foregoing wetting agents may also be employed, and, if desired, foam-reducing additive may be added as appropriate to minimize undesirable foaming tendencies of these wetting agents under conditions of use.

The detergent material is employed in concentrations ranging from about 0.5 to about 5% by weight of total compositions with a range of 1 to 3% being particularly preferred.

Thus, a relatively minor amount of nonionic type detergent, that is, about 2–4% is especially beneficial inasmuch as it acts as a foam depressant as well as a detersive agent in an automatic dishwashing solution.

The preferred cleaning compositions of this invention can contain any of the usual additives such as filler, extenders, pigments, dyes, anti-tarnishing agents, suds depressors, suds builders, anti-redeposition agents, polyelectrolytes which function as soil suspending and/or peptizing agents including polycarboxylates, polyamino-methyl phosphonate, maleic anhydrideacrylic acid polymer, starch degradation products, polymethyl vinyl ether/maleic acid, and the like, overglaze protectors including aluminum acetate, aluminum formate, alkali aluminate, zincate, berylliate, boric acid, boric anhydride, etc., which do not interfere with the detergency properties thereof. In various examples herein, polyaminomethyl phosphonate is shown in very small amounts and this organic material is optional, and may be replaced by any suitable soil suspending and/or peptizing agent such as said polycarboxylates. The compositions are prepared usually by dry-blending the ingredients to form a dry particulate product such as a free-flowing granular composition or powder.

The following examples are given for purposes of illustration only and are not to be considered as constituting a limitation on the present invention. All parts and percentages given are by weight unless otherwise indicated.

EXAMPLE 1

| Ingredients | % |
|---|---|
| Trisodium citrate dihydrate | 45.0 |
| Nonionic detergent* | 2.0 |
| Potassium dichloroisocyanurate | 2.0 |
| Sucrose | 6.0 |
| Polyamino methylphosphonate | 0.5 |
| Boric Acid | 3.0 |
| Boric anhydride | 3.0 |
| Sodium sulfate | 20.0 |
| Sodium carbonate | 8.5 |
| Sodium metasilicate, anhydrous | 10.0 |
| | 100.0 |

*The non-ionic detergent is the product obtained by the condensation of about three mols of propylene oxide with the condensation product of one mol of a mixture of essentially straight chain, primary, fatty alcohols in the $C_{10}$–$C_{18}$ range with about six mols of ethylene oxide.

Detergency efficacy evaluated in accordance with the CSMA method hereinbefore described using 140° F tap water resulted in a rating of 2S–1F for glasses and 2S–2F for slides (S=spotting; F=filming), which was comparable to conventional phosphate-containing compositions. Its overall machine performance with regard to soil removal, lipstick removal, the cleaning of utensils of stainless steel, silverware, copper water and aluminum ware was equivalent to conventional detergents. However, its performance in regard to tea stain removal was superior; 99% as compared to 80% for conventional detergents.

EXAMPLE 2

Example 1 is repeated, but the 10% metasilicate is omitted and replaced by an additional 10% sodium carbonate.

Detergency performance is substantially similar to that of Example 1.

EXAMPLE 3

Example 1 is repeated, except that the sodium carbonate content is increased to 20% and the sodium sulfate is reduced to 8.5%. A solution of this composition as used has a pH of 10.2–10.5.

The spotting and filming rating of this composition was 1.2S–1.4F for glasses and 1S–1.4F for slides, which is indicative of a further reduction in spotting and filming.

CSMA overglaze tests at 0.15 and 0.30% concentrations after six hours immersion gave a rating of 1, which was superior to a 2 rating for the conventional phosphate containing products.

EXAMPLE 4

Example 3 is repeated but the boric acid and boric oxide is eliminated and repaced by 6% additional sodium sulfate.

EXAMPLE 5

Example 3 is repeated, but the sucrose is eliminated and replaced by 6% additional sodium sulfate, yielding a solution having a pH of 10.2–10.5 during use, and an overglaze rating of 1.

EXAMPLE 6

Example 3 is repeated, but the polyamino methylphosphonate is replaced by 0.5% additional sodium sulfate.

EXAMPLE 7

Example 3 is repeated, but the sodium citrate is reduced to 35% and the sodium sulfate increased to 30%.

EXAMPLE 8

Example 3 is repeated but 10% hydrous silicate replaces the anhydrous silicate, yielding a solution during use with a pH of 9.8–10.1 and an overglaze rating of 1.

EXAMPLE 9

| Ingredient | % |
|---|---|
| Sodium citrate dihydrate | 45.00 |
| Nonionic surfactant ethyoxylated alcohol | 2.00 |
| Potassium dichloroisocyanurate | 2.00 |
| Sucrose fine granular | 6.00 |
| Boric acid | 3.00 |
| Boric oxide | 3.00 |
| Sodium metasilicate, anhydrous | 10.00 |
| Sodium carbonate | 20.00 |
| Sodium sulfate, anhydrous | 8.35 |
| *polyamino-methylphosphonate | 0.50 |
| Perfume | 0.15 |

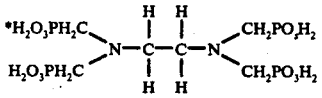

EXAMPLE 10

Example 9 is repeated but 2% talc is added and the sodium sulfate is reduced to 6.35%.

EXAMPLE 11

Repeat Example 3, but reduce the sodium citrate dihydrate from 45 to 25% and add 20% anhydrous citrate. Density of this product is 0.92.

EXAMPLE 12

Example 3 is repeated but the sodium citrate dihydrate content is reduced to 35% and 10% anhydrous citrate is added. Density of this product is 0.95.

EXAMPLE 13

| Ingredients | % |
|---|---|
| Na citrate dihydrate | 45.0 |
| polyamino-methyl phosphonate | 0.5 |
| Potassium dichloroisocyanurate | 3.0 |
| Nonionic detergent - Ex. 1 | 2.0 |
| Sucrose | 4.0 |
| Boric Acid | 1.5 |
| Sodium silicate ($SiO_2/Na_2O$ ration of 2:1) | 10.0 |
| Soda Ash | 27.0 |
| Na sulfate | 5.5 |
| Boric Oxide | 1.5 |

EXAMPLE 14

| Ingredients | % |
|---|---|
| Na Citrate dihydrate | 36.89 |
| Polyamino-methylphosphonate | 0.41 |
| Potassium dichloroisocyanurate | 1.64 |
| Nonionic detergent - Ex. 1 | 1.64 |
| Sucrose | 4.92 |
| Boric Acid | 1.23 |
| Boric Oxide | 1.23 |
| Sodium metasilicate | 8.20 |
| Soda Ash | 34.67 |
| Sodium sulfate | 9.17 |

While the detergent composition of the present invention finds most efficacious utilization in connection with the washing of the dishes and the like in automatic dishwashers, naturally, the detergent may be utilized in other fashions as desired. Usually, however, the best mode of use will be in connection with automatic dishwashers which have the ability of dispensing the detergent of the present invention in one or more separate wash cycles. Accordingly, the detergent composition of the present invention is added to the two receptacles, if such are present, in an automatic dishwasher. When the dishwasher is set into operation, after the dishes have been suitably positioned therein, the automatic devices of the dishwasher permit the addition of sufficient water to produce a concentration of the detergent composition of approximately 0.3% by weight. The operation of the dishwasher results in treating, that is, washing of the dishes with the aqueous solution of the detergent composition. Usually, the sequence of operation in utilizing an automatic dishwasher results in one or more rinsing steps following the one or more washing cycles. In utilizing the detergent composition of the present invention it will be noted that even after use in considerable number of washings there will be substantially favorable overall detergency performance with little if any attack on the overglaze of china.

Effective industrial bottle cleaning compositions may be provided in accordance with the present invention by merely admixing the detergent formulation with suitable active ingredients, e.g., caustic alkali whereby to provide a highly alkaline composition preferably having a pH of approximately 12. Such compositions may be readily formulated in accordance with the parameters hereinbefore described.

Results similar to those described in the foregoing examples are obtained when the procedures delineated therein are repeated but employing in lieu of the specific non-ionic detergent identified a variety of materials selected from nonionic, anionic, cationic, amphoteric and zwitterionic types. Moreover, various bleaching agents hereinbefore recommended for such purposes may be readily employed to advantage. Similarly, any citrate compound or combination of citrate compounds together with compatible inorganic water soluble non-phosphate salts can advantageously be utilized in the formulation of instant dishwasher cleaning composition.

It will be apparent that many changes and modifications of the several features described herein may be made without departing from the spirit and scope of the invention. It is therefore apparent that the foregoing description is by way of illustration of the invention rather than limitation of the invention.

What is claimed:

1. An alkaline dishwahser detergent capable of inhibiting overglaze attack and essentially free of inorganic phosphates consisting essentially of, (A) as the sole builder components, about 35–60% by weight of a water soluble hydrated citrate compound, alone or in admixture with a water soluble anhydrous citrate compound and about 30–65% by weight of at least one water soluble inorganic builder salt selected from the group consisting of silicates having an $SiO_2$ to $Na_2O$ ratio from 1:1 to 3.2:1, carbonates and sulfates, (B) about 2.46 to 6% by weight of boric acid and (C) about 0.5 to 5% by weight of bleaching agent capable of liberating hypochlorite or hypobromite, said composition having a pH in water of from 9.5 to 12.

2. A composition in accordance with claim 1 which also includes about 0.5 to 5% by weight of ethoxylated low foaming water soluble nonionic organic detergent which is derived from a $C_8$ to $C_{22}$ hydrocarbon alcohol condensed with from 6 to 30 moles of ethylene oxide.

3. A composition in accordance with claim 2, wherein the citrate compound is sodium citrate.

* * * * *